US006230984B1

(12) United States Patent
Jager

(10) Patent No.: US 6,230,984 B1
(45) Date of Patent: May 15, 2001

(54) APPARATUS FOR THE EJECTION OF LIQUID

(76) Inventor: Anton Jager, Hofackergasse 3, Senden (DE), 89250

( * ) Notice: Subject to any disclaimer, the term of this patent is extended or adjusted under 35 U.S.C. 154(b) by 0 days.

(21) Appl. No.: 09/350,321

(22) Filed: Jul. 9, 1999

(30) Foreign Application Priority Data

Jul. 9, 1998 (DE) ..... 198 30 801

(51) Int. Cl.[7] ..... B05B 3/00

(52) U.S. Cl. ..... 239/225.1; 239/237; 239/381; 239/383

(58) Field of Search ..... 239/159, 160, 239/162, 237, 240, 243, 244, 245, 246, 248, 249, 251, 263, 264, 380, 381, 382, 383, 525, 530, 548, 550, 556, 557, 566, 754, DIG. 6, 225.1; 15/50.1, 320, 321, 322, 29

(56) References Cited

U.S. PATENT DOCUMENTS

| | | | | |
|---|---|---|---|---|
| 903,788 | * | 11/1908 | Schmidt | 239/251 X |
| 2,896,861 | * | 7/1959 | Hruby, Jr. | 239/383 X |
| 3,199,786 | * | 8/1965 | Waldrum | 239/162 X |
| 3,547,352 | * | 12/1970 | Hadsel | 239/383 |
| 3,829,019 | * | 8/1974 | Petsch | 239/251 |
| 4,200,239 | * | 4/1980 | Briar | 239/754 X |
| 4,377,018 | * | 3/1983 | Cain | 15/322 |
| 4,989,786 | * | 2/1991 | Kranzle et al. | 239/263 X |
| 5,078,161 | * | 1/1992 | Raghavan et al. | 239/160 X |
| 5,332,155 | * | 7/1994 | Jager | 239/264 X |
| 5,433,383 | * | 7/1995 | Sundholm | 239/383 |
| 5,551,635 | * | 9/1996 | Jager | 239/264 X |
| 5,826,298 | * | 10/1998 | Rohrbacher et al. | 15/321 |
| 6,029,681 | * | 2/2000 | Gaydoul et al. | 239/264 X |

FOREIGN PATENT DOCUMENTS

| | | |
|---|---|---|
| 3827251A1 | 2/1990 | (DE) . |
| 9108507 | 12/1991 | (DE) . |
| 4239542A1 | 9/1993 | (DE) . |
| 195 11 820A1 | 10/1996 | (DE) . |

* cited by examiner

*Primary Examiner*—Patrick Brinson
*Assistant Examiner*—Steven J. Ganey
(74) *Attorney, Agent, or Firm*—Townsend and Townsend and Crew LLP

(57) ABSTRACT

The invention relates to an apparatus for the ejection of liquid comprising a plurality of rotor nozzles which are combined into a unit. Each rotor nozzle has a rotor space formed in a nozzle housing and an inlet opening in the region of its one axial end and an outlet opening for the liquid at the other end, as well as a rotationally driven rotor arranged inclined in the rotor space relative to its longitudinal axis and supported at the inner wall of the rotor space. The rotor has a nozzle region supported in a cup bearing at its end pointing towards the outlet opening and an inflow opening at the opposite end.

30 Claims, 6 Drawing Sheets

APPARATUS FOR THE EJECTION OF LIQUID

BACKGROUND OF THE INVENTION

The invention relates to an apparatus for the ejection of liquid.

With such apparatuses articles and surfaces can be cleaned or processed.

BRIEF SUMMARY OF THE INVENTION

It is an object of the invention to provide an apparatus of the initially named kind which permits a most effective cleaning or treatment.

This object is satisfied in that a plurality of rotor nozzles are provided which are combined into a unit, with each rotor nozzle having a rotor space formed in a nozzle housing and having an inlet opening in the region of its one axial end and an outlet opening for the liquid at the other end, as well as a rotationally driven rotor arranged inclined in the rotor space relative to its longitudinal axis and supported at the inner wall of the rotor space, the rotor having, at its end pointing towards the outlet opening, a nozzle region supported in a cup bearing and an inflow opening at the opposite end.

With the rotor nozzles provided in accordance with the invention, which can also be termed rotary nozzles, the liquid, in particular water, can be ejected in the form of a conical liquid jet. The combination of a plurality of rotor nozzles into a unit thus also permits an effective and time-saving cleaning or treatment of larger surfaces and articles. Moreover, through the combination of a plurality of rotor nozzles a compact and thus space-saving ejection or expulsion apparatus is provided.

Rotor nozzles can be used over a wide range of liquid pressures and indeed already from a normal mains water pressure of about 3 bar up to pressures of several hundred bar, such as are for example customary in high-pressure cleaning apparatuses. The invention consequently opens up a large variety of possibilities of use both in private houses and in the garden area (for example as a garden shower with a vertically extending nozzle housing) and also in the professional and commercial environment and indeed for example for cleaning, surface treatment, sprinkling and/or watering purposes. Speeds of rotation of the rotor of approximately 300 revolutions per minute are already achieved in the low pressure region. The expulsion apparatus of the invention can be made mobile or stationary, for example arranged on a conveying means for materials or articles to be cleaned or processed.

In accordance with a preferred embodiment of the invention, the nozzle housing is of plastic and is preferably manufactured using an injection molding process.

This makes it possible to manufacture an ejection apparatus with low weight simply, quickly and at favorable cost.

In accordance with a further preferred embodiment of the invention, the outlet opening and/or the cup bearing of each rotor nozzle are formed on a separate plug, which is inserted into the rotor space and sealingly connected to the nozzle housing, preferably fused thereto.

The assembly of the expulsion apparatus is simplified in this way, since after the manufacture of the nozzle housing, in which the individual rotor spaces are already formed, only one rotor has to be inserted into each rotor space and then the rotor space closed by means of the plug.

DESCRIPTION OF THE PREFERRED EMBODIMENTS

Figure 1A:
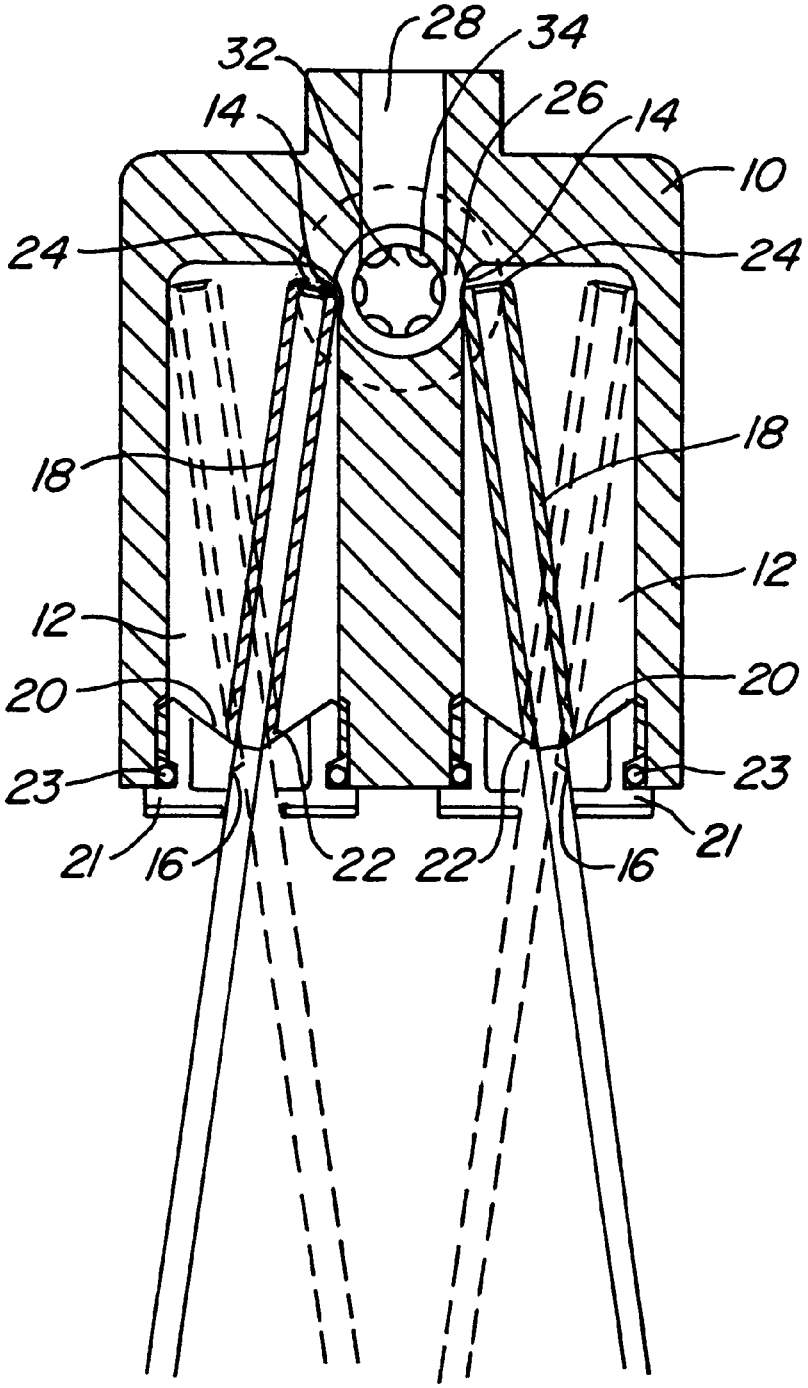
FIG. 1*a* is a side view of a nozzle housing having two rotor spaces in accordance with one embodiment of the invention.

FIG. 1*a* shows a nozzle housing 10 of an embodiment of an ejection or expulsion apparatus in accordance with the invention in which two cylindrical rotor spaces 12 are formed (which are also termed swirling chambers), with their longitudinal axes arranged parallel to one another. The nozzle housing 10 is a plastic component manufactured in an injection molding process, but can, however, also be manufactured in a different manner and from a different material.

Each rotor space 12 has, in the region of its one axial end, an inlet opening 14 which opens in the radial direction into the rotor space 12.

A respective plug 21 is inserted in each case into the oppositely disposed axial end of the rotor spaces 12. The rotor spaces 12 are sealed off towards the outside by O-rings 23 which are arranged between the inner wall of the rotor spaces 12 and plugs 21.

A cup bearing 20 for a hollow cylindrical rotor 18 is in each case formed at the plug 21 around a central outlet opening 16. The rotor 18 has at its one end a nozzle region 22, with which it is supported on the cup bearing 20 and at the other end an inflow opening 24. Instead of a nozzle region 22, a separate nozzle can also be provided which is connected to the hollow cylindrical remainder of the rotor 18.

Two possibilities of supplying the rotor spaces 12 with liquid are shown in FIG. 1*a*, which will be discussed in the following.

The rotor spaces 12 communicate via their inlet openings 14 with a ring passage 26, into which a central supply passage 28 for liquid opens. The central supply passage 28 extends parallel to the axes of the rotor spaces 12 and is formed in the nozzle housing 10. A passage 32 extends perpendicular to the supply passage 28 and between the rotor spaces 12, and a connection bar (not shown) can be inserted into the passage 32, by means of which a plurality of nozzle housings can be arranged behind one another. This will be explained in more detail in the following with reference to FIGS. 1*b* and 1*c*.

The inner wall of the passage 32 is provided with projections 34, which can be formed as knobbles or as ribs which extend along the passage 32. When the connection rod is inserted, an intermediate space, i.e. passages, arise between the connection rod and the inner wall of the passage 32, which, in a manner not shown in FIG. 1*a*, communicate at one point with the supply passage 28, and, in the region of the rotor nozzles, communicate with the rotor spaces 12 via respective inlet openings 14. Instead of knobbles or ribs, the connection rod can also be provided, with a smooth wall of the passage 32, with a plurality of channels extending in the longitudinal direction and arranged distributed in the circumferential direction, which serve to supply the rotor spaces 12 with liquid.

The rotors 18 of the rotor nozzles can be set in rotation by liquid, which flows into the rotor spaces 12 through their inlet openings 14 in the radial direction. The inlet openings can also be arranged in such a way that the liquid flows in tangentially. It is important that a radial flow component is present which serves to generate eddies which drive the rotor 18. The rotor 18 can be provided with elements such as vanes or ribs at its outer surface, which increase the driving effect.

The rotor nozzles of the expulsion apparatus of the invention each comprise only a rotor space 12 formed in the nozzle housing 10, a rotor 18 which can be set rotating and a plug 21, on which the outlet opening 16 and the cup bearing 20 are formed. They can therefore be manufactured simply and at favorable cost, in particular by way of mass production.

In the operation of the expulsion apparatus of the invention, liquid flows via the central supply passage 28 either into the ring passage 26, which communicates via inlet openings 14 with the rotor spaces 12, or into the space or the channels between the knobbles or ribs at the inner wall of the passage 32. The liquid flowing into the rotor spaces 12 produces eddies which rotate about the longitudinal axes of the rotor spaces, by which the rotors 18 are set rotating. The liquid enters into the rotors 18 via their inflow openings 24 and flows out of the nozzle housing 10 through the outlet openings 16 formed in the plugs 21.

The rotors 18 which rotate in opposite directions in the embodiment of FIG. 1*a* are supported in the operation, in the region of their inflow openings, at the inner wall of the respective rotor space 12, and at their nozzle regions 22, on the respective cup bearing 20.

As a consequence, conical liquid jets are expelled from the nozzle housing 10 through the outlet openings 16. At each point in time there is a different instantaneous position of the rotor, i.e. a different instantaneous direction of the expelled jet, as indicated in FIG. 1 with broken lines.

Basically it is also possible to provide only one rotor space in each nozzle housing, and a plurality of nozzle housings can, for example, be arranged behind one another or alongside one another and thus combined into a unit in a modular manner.

In accordance with FIG. 1*b*, at least two of the nozzle housings 10 described with reference to FIG. 1*a* are arranged behind one another on a non-illustrated connection rod introduced into the passages 32 of the nozzle housings 10 extending perpendicular to the longitudinal axes of the rotor spaces 12. In this manner a modularly constructed expulsion apparatus is provided which includes a plurality of modules each having two rotor spaces 12. The modules can be rotated relative to one another so that it is simultaneously possible to operate in a plurality of directions with a single expulsion apparatus.

Basically, only one or more than two rotor spaces can be formed in the nozzle housings of the modules and/or as many modules as desired can be arranged behind one another on the connecting rod or on a connection element executed in a different manner.

In this manner an expulsion apparatus is provided by the invention which can be ideally matched to the respective application, which, for example, also enables a simple and effective internal cleaning of vessels such as tanks, barrels, etc.

Figure 1C:
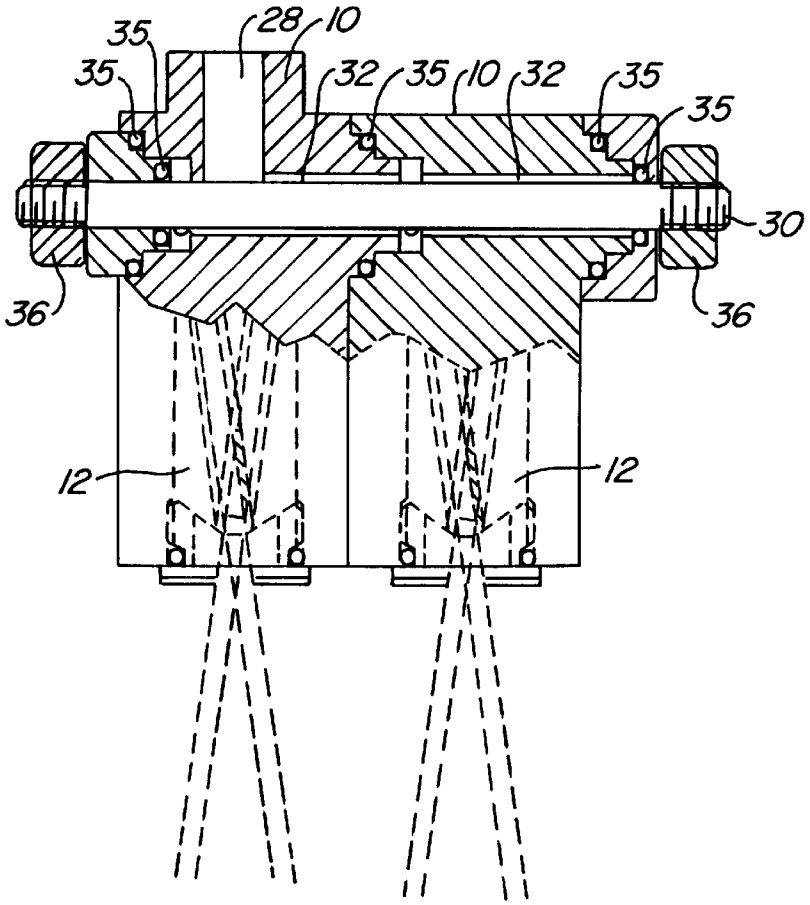
FIG. 1*c* shows an arrangement in accordance with FIG. 1*b*, in a side view turned through 90°.
Figure 1B:
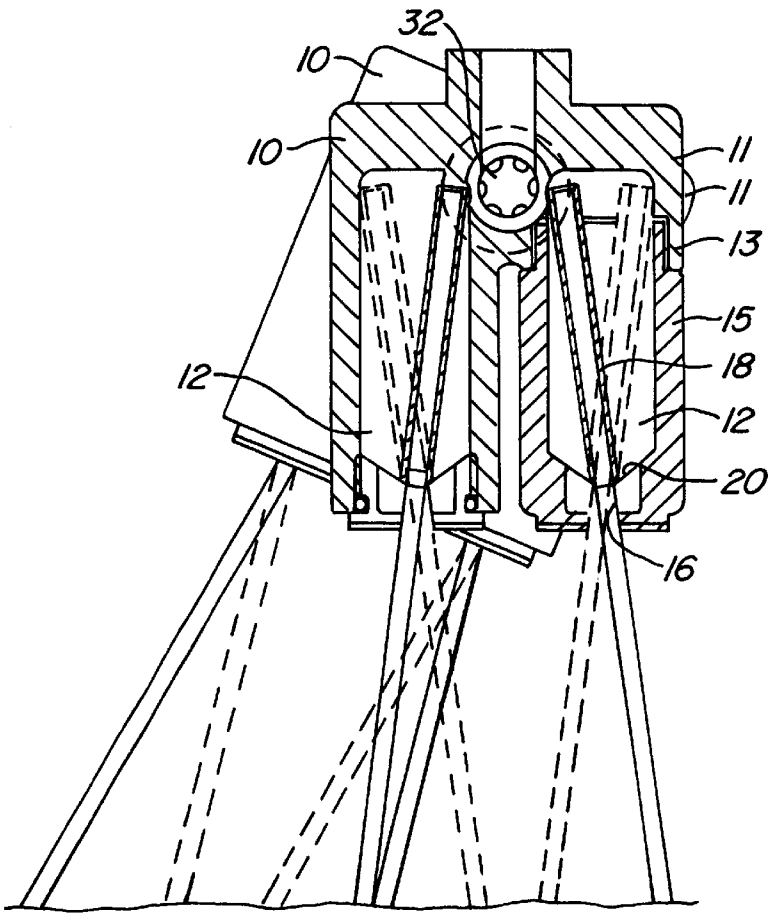
FIG. 1*b* shows two nozzle housings which are arranged turned relative to one another.

An alternative design of the nozzle housing is shown with reference to the right-hand rotor nozzle in FIG. 1*b*. The nozzle housing 10 of this alternative design includes a carrier element 11, on which a connection stub 13 for a sleeve element 15 of the rotor nozzle is formed, which bounds the predominant part of the rotor space 12. The sleeve element 15 is sealingly connected to the connection stub 13 in dependence on the material used, for example fused or screwed to it.

The cup bearing 20 for the rotor 18 is formed in one piece with the sleeve element 15 and provided with the outlet opening 16.

The carrier element 11 and the sleeve element 15 are preferably plastic parts manufactured by the injection molding process or they consist of metal, preferably of impact-molded brass or impact brass.

In accordance with this alternative, the rotor space 12 is consequently formed in a multi-part nozzle housing, i.e. is bounded by a multi-part nozzle housing 10, namely, on the one hand, by the connection stub 13 of the carrier 11, and, on the other hand, in the specifically illustrated embodiment predominantly by the sleeve element 15.

Preferably all the rotor spaces of at least one module, and preferably of the entire expulsion apparatus, are formed in a single piece or multi-piece nozzle housing, i.e. either in accordance with the alternative shown at the left in FIG. 1*b*, or in accordance with the alternative shown on the right in FIG. 1*b*.

It is also possible to connect one or more complete rotor nozzles, which each have their own nozzle housing fully bounding the rotor space, to the connection stubs or to connection regions of a carrier element formed in a different manner. A plurality of such modules can be combined into a unit. Such carrier elements are thus not a component of the nozzle housings but rather each form a connection piece for one or more rotor nozzles which each have their own nozzle housing.

FIG. 1*c* shows a side view of an expulsion apparatus in accordance with the invention formed in accordance with FIG. 1*b*, which includes modules arranged on a connection rod 30. One or more rotor spaces 12 can be formed in each module.

The nozzle housings 10 of the modules each have a plug end and a socket end matching it, so that basically as many nozzle housings 10 as desired, which are identically designed in this respect, can be plugged together in series. The sealing between two modules relative to one another and also between a first and a last module and suitable end pieces takes place by O-rings 35. The arrangement is held together by means of securing elements 36 pushed onto the ends of the connection rod 30.

One module is formed as a connection module and has a supply passage 28 for liquid extending perpendicular to the connection rod 30 and formed in the nozzle housing 10. The supply passage 28 opens into the intermediate space, i.e. into the channels between knobbles or ribs (both not shown), which are formed on the inner wall of the passage 32 for the connection rod 30.

The rotor space or the rotor spaces 12 of the module which is not provided with a supply passage 28—the right-hand module in FIG. 1*c*—is/are connected via this intermediate space, or via these passages, to the supply passage 28 so that all modules of the expulsion apparatus can be supplied with liquid through only one supply passage 28.

The rotor nozzles used in the following embodiments each correspond—if not stated differently—to the above-described rotor nozzles with respect to the above-mentioned possibilities for the basic layout and with respect to the operating principle. Furthermore, in the embodiments which will be described in the following, one or more carrier elements can be provided in place of the respectively shown nozzle housing and connected to sleeve elements or to complete rotor nozzles, as has been explained in connection with FIG. 1*b*.

Figure 2:
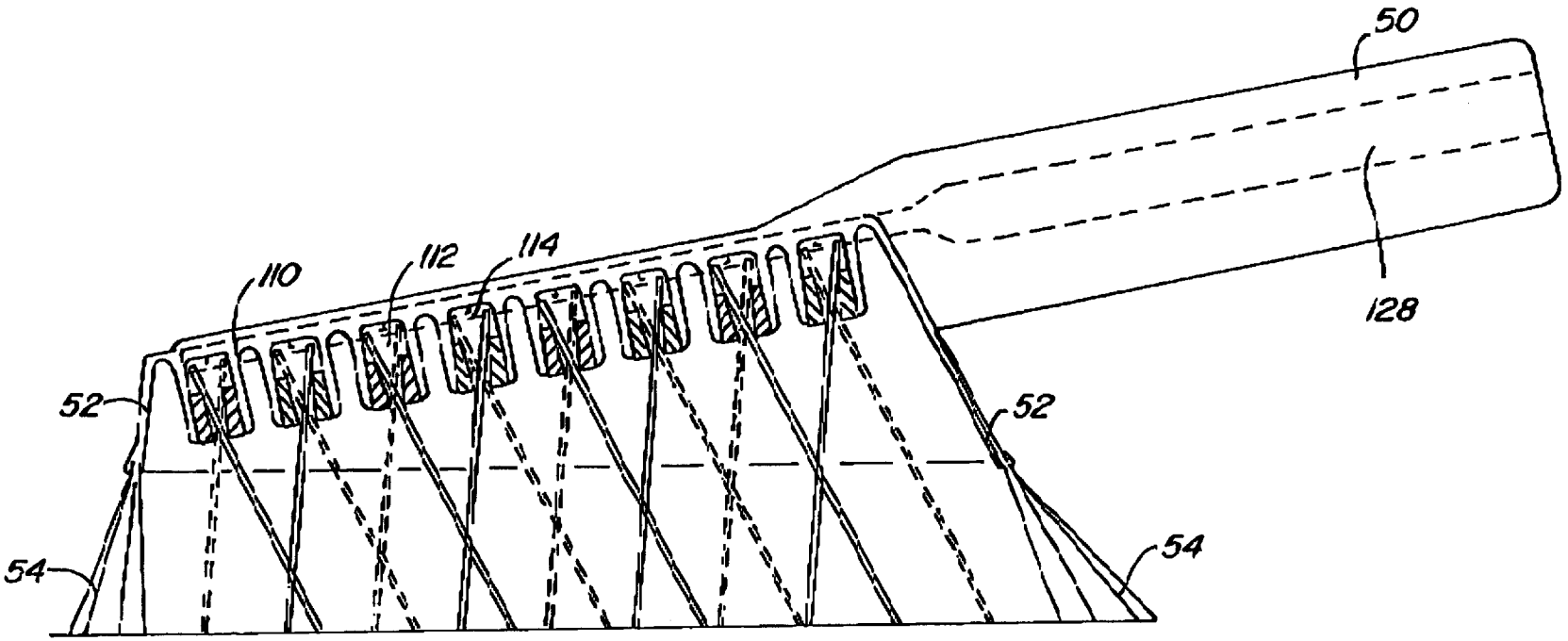
FIG. 2 is a side view of an expulsion apparatus in accordance with the invention formed as a hand-held washing brush.

In the embodiment of FIG. 2 the expulsion apparatus of the invention is formed as a hand-held washing brush and includes a nozzle housing 110 manufactured of plastic by the injection molding process. A plurality of rotor spaces 112 is formed in the nozzle housing 110, and the rotor spaces are arranged in a plurality of rows, preferably in two or three rows, of which only one is shown in FIG. 2. The rotor nozzles are so arranged that the emerging conical jets partly overlap.

It is possible to manufacture very small rotor nozzles, which, for example, have an extent in the expulsion direction of a few centimeters, for example only 2 to 3 cm. Such rotor nozzles are preferably used for the hand-held washing brush in accordance with FIG. 2 in order to achieve a high jet density in the working surface of the brush.

The nozzle housing 110 is connected in one piece to a handle part 50, in which a supply passage 128 for the liquid is formed. The supply passage 128 extends with reduced cross-section through the nozzle housing 110, and is connected via non-illustrated passages to the individual rotor spaces 112. In the case of a two-row arrangement of rotor spaces 112, these passages for example each branch off at the level of the respective rotor space 112 from a supply passage 128 extending between the two rows. In FIG. 2 the inlet openings 114 of the rotor spaces 112 are indicated through which the liquid flows in, in each case radially or tangentially.

The rotor spaces can also each be connected by a hose to a supply passage formed, for example, in the handle. The formation of supply passages in the nozzle housing can then be omitted, whereby its manufacture is simplified.

In the region of the ends of the rotor space row(s), the nozzle housing 110 is provided with projections 52 extending in the expulsion direction, with brushes 52 attached to the projections 52. Such brushes can be provided over the entire edge region of the nozzle housing 110 and also distributed between the individual rotor nozzles.

Figure 3B:
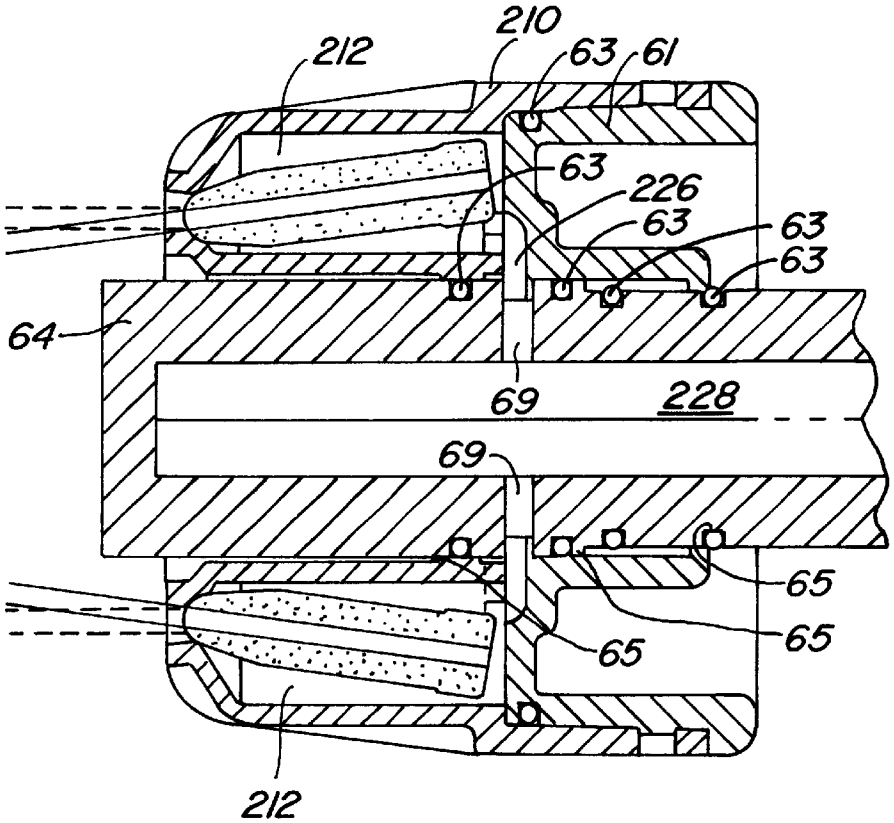
FIG. 3*b* shows an arrangement in accordance with FIG. 3*a* in a side view turned through 90°.
Figure 3A:
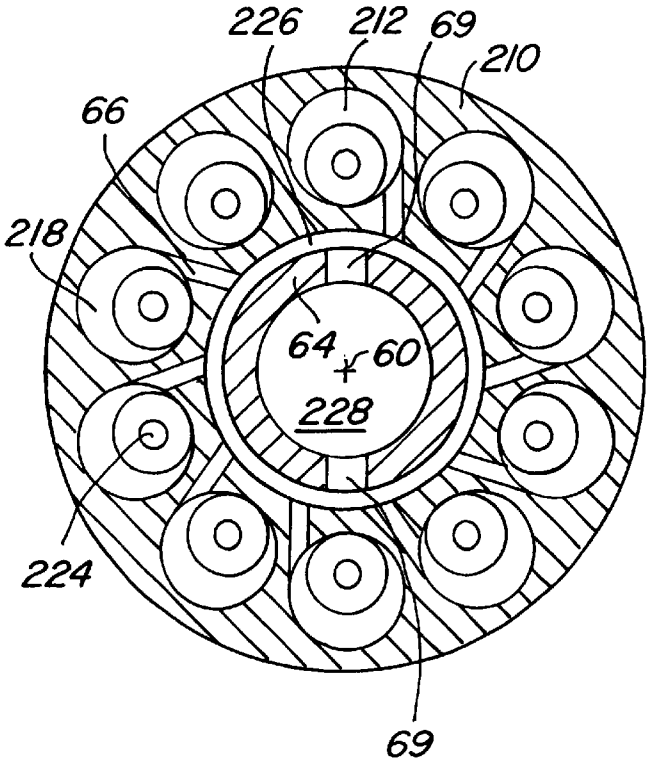
FIG. 3*a* is a side view in the direction of the longitudinal axes of rotor spaces of an expulsion apparatus in accordance with the invention formed as a shower and/or massage head.

In accordance with FIG. 3*a*, the expulsion apparatus of the invention is formed as a shower head. A cylindrical nozzle housing 210 is mounted on a spigot 64, which extends through a central passage of the nozzle housing 210, with its longitudinal axis coinciding with a central axis 60 of the nozzle housing 210.

Rotor spaces 212, which are each associated with a rotor nozzle, are formed in the nozzle housing 210 arranged distributed on a circle about the central axis 60. Each rotor space 212 is connected via a passage 66, which opens tangentially into the rotor space 212 to a ring passage 226 between the central spigot 64 and the inner wall of the nozzle housing 210 facing the latter. The ring passage 226 communicates via two transverse bores 69 with a supply passage 228 for the liquid formed in the central spigot 64.

In FIG. 3*a* it is also possible to recognize rotors 218 arranged in the rotor spaces 212 and their inflow openings 224. The tangentially opening supply passages 66 are arranged such that in operation the rotors 218 rotate (in the illustration of FIG. 3*a*) in the counterclockwise sense.

With the expulsion apparatus of the invention formed as a shower head, a larger surface can thus be sprayed than with outlet openings simply in the form of bores and, moreover, a massaging action can be achieved.

FIG. 3*b* shows a shower or massage head in a sectioned side view turned through 90° relative to FIG. 3*b*. The ring passage 226 for the supply of the rotor spaces 212 with liquid is provided between the nozzle housing 210 and a further housing element 61, which is arranged in front of the nozzle housing 210 in the expulsion direction and surrounded at the outer side by the nozzle housing 210.

The arrangement comprising the nozzle housing 210 and the further housing 61 is displaceably mounted on the central spigot 64, which projects beyond the outlet end of the nozzle housing 210. For weight reduction, the central supply passage 228, which can be connected to a water line, extends beyond the plane of the transverse bore 69 into the spigot 64. O-rings 63 are provided for the seal between the individual components.

In the position of FIG. 3*b* the liquid can flow tangentially into the rotor spaces 212 and take care of a rotational operation. By shifting the housing arrangements 210, 61 relative to the central spigot 64, the connection between the central supply passage 228 and the rotor spaces 212 can be cut off. Projections 65, which can be formed as peripherally extending ribs on the inner wall of the nozzle housing 210 of the further nozzle element 61 and also on the outer wall of the central spigot 64, serve as end abutments which restrict the axial displacement.

The shower or massage head in accordance with FIGS. 3*a* and 3*b* can also be designed such that by shifting the housing arrangement 210, 61 either customary outlet bores, which do not bring about any driving of the rotors 218—not shown in FIGS. 3*a* and 3*b*—or such inlet openings of the rotor spaces 212 can be connected flow-wise to the central supply passage 228. In this manner it is possible to change over between a rotational operation and a normal operation with intermediate positions, with components of both types of operation being possible.

Figure 4:
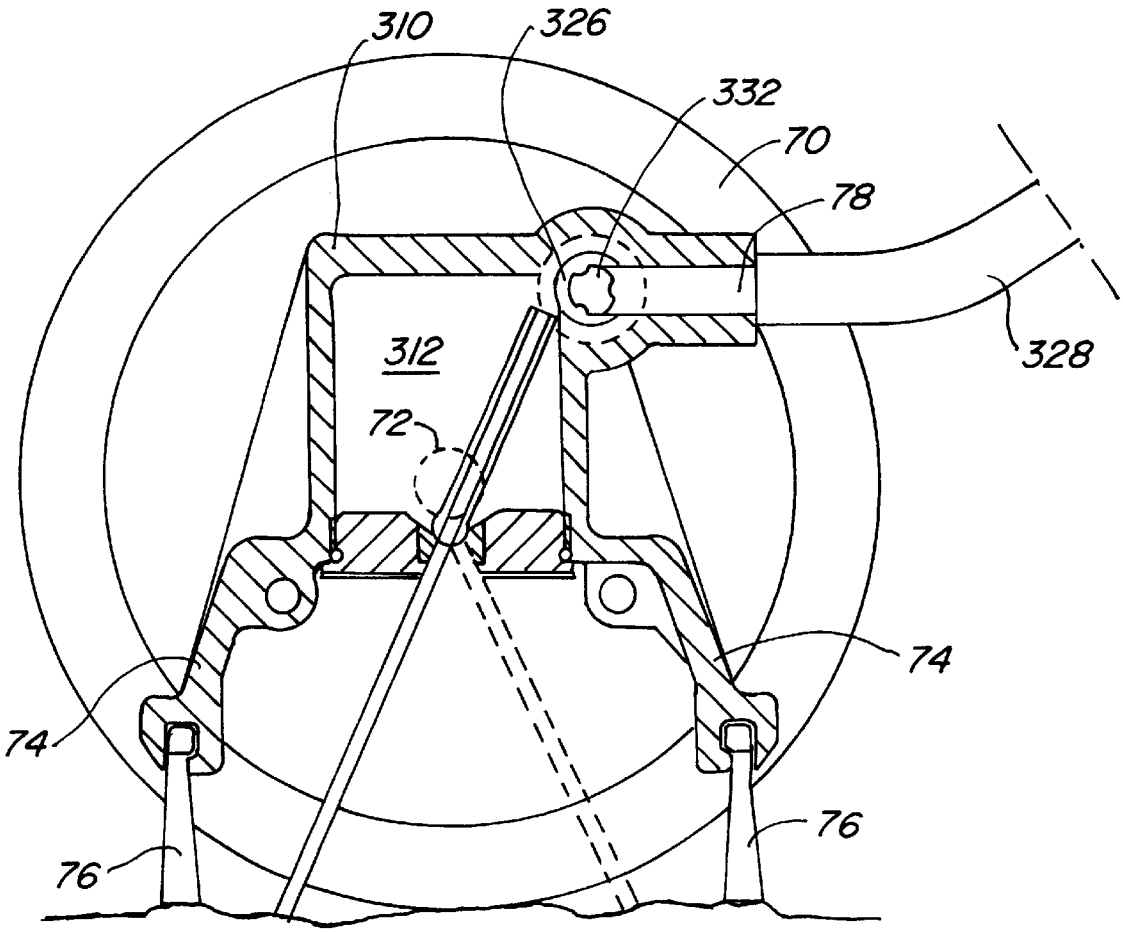
FIG. 4 is a side view of a mobile expulsion apparatus in accordance with the invention.

In the embodiment shown in FIG. 4 of an expulsion apparatus in accordance with the invention a plurality of rotor nozzles are formed in a single-row arrangement in a nozzle housing 310. The expulsion apparatus is movably designed, which is indicated in FIG. 4 by a wheel 70, which is mounted on the nozzle housing 310. The nozzle housing 310 extends transversely to the wheel axle 72, so that the row of rotor spaces 312 extends perpendicular to the direction of travel.

The nozzle housing 310 can also be provided with wheels at both ends and—in dependence on its length—also between the rotor spaces 312. Alternatively it can be secured at one end to a vehicle, for example in the manner of a boom.

A passage 332 extending parallel to the wheel axle 72 is formed in the nozzle housing 310, in the sense of the embodiment in accordance with FIGS. 1*b* and 1*c*, with its inner wall provided with knobbles or ribs. A non-illustrated connection rod can be introduced into this passage. The passage 332 communicates in the region of each rotor nozzle with the inlet opening of the respective rotor space 312 via a ring-passage 326.

The passage 332 is connected via a transverse bore 78 to a supply passage 328 for the liquid which is indicated in FIG. 4.

The nozzle housing 310 is provided with projections 74 extending in the expulsion direction on which cleaning brushes 76 are attached.

The expulsion apparatus in accordance with FIG. 4 is suitable for the cleaning of roads or large areas, such as airfields, and can basically also be manufactured in any desired length. The effectiveness can also be increased by a multi-row arrangement of rotor nozzles.

Figure 5B:
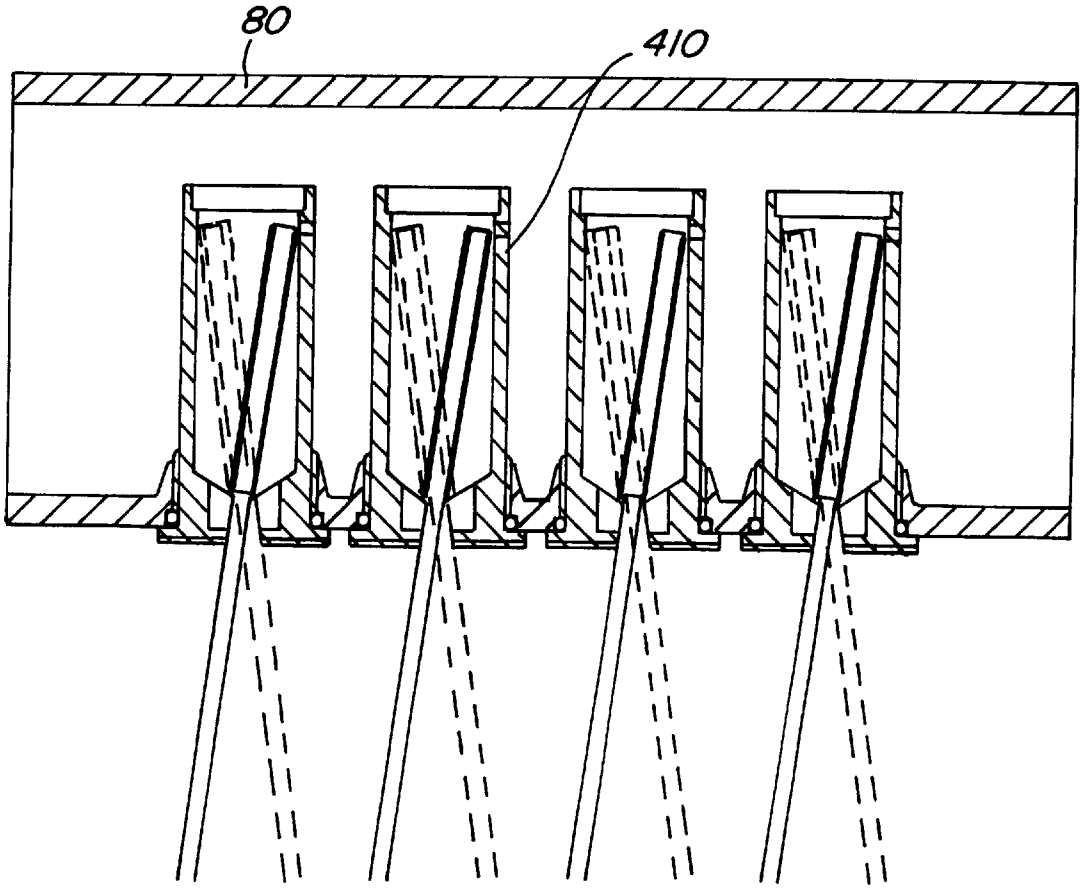
FIG. 5*b* shows the arrangement of FIG. 5*a* in a side view turned through 90°.
Figure 5A:
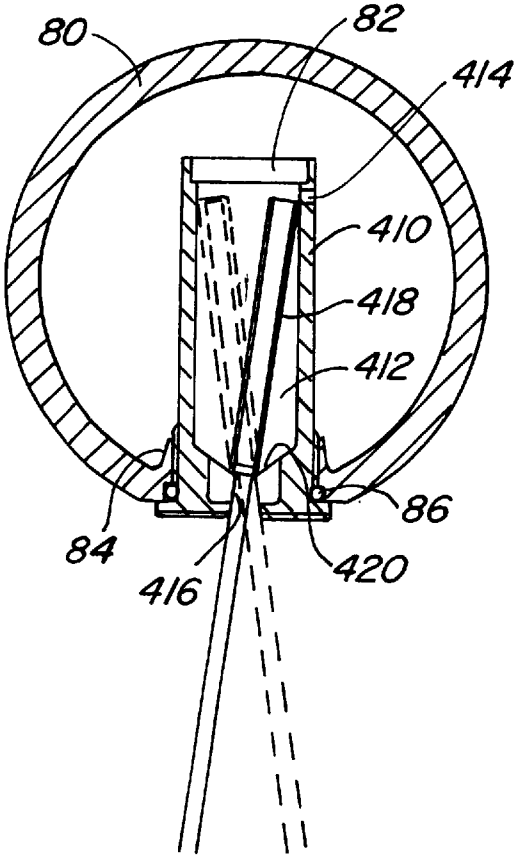
FIG. 5*a* is a sectional view in the direction of a longitudinal axis of a tube of an expulsion apparatus in accordance with the invention having separate rotor nozzles.

FIGS. 5*a* and 5*b* show an embodiment of an expulsion apparatus in accordance with the invention in which, in distinction to the previously explained embodiments, each rotor nozzle (only one shown in FIG. 5*a*) has its own nozzle housing 410. The outlet end of each nozzle housing 410 is formed as a cup bearing 420 and provided with an outlet opening 416. After the introduction of the rotor 418 into the rotor space 412, the nozzle housing 410 is closed by a plug 82. Liquid can flow in the radial direction into the rotor space 412 through an inlet opening 414 formed in the housing wall.

The rotor nozzles are inserted into a tubular holding part 80, which can be connected to a liquid source and which consequently serves as a supply passage. The holding part 80 preferably consists of impact molded brass or of impact brass. Openings are formed in the holding part 80, which are produced by a chipless forming process. Threads are cut into the inwardly directed material beads 84 which arise in this way, so that the rotor nozzles can be screwed into the holder part 80. The sealing takes place by O-rings 86.

With a very small embodiment of the rotor nozzles in particular, for example, with an extent in the expulsion direction of a few centimeters, for example 2 to 3 cm, the latter can be termed rotor cartridges, which are pre-manufactured and which are immediately ready for operation after being inserted into a corresponding opening of a holder part.

FIG. 5*b* shows the above-explained arrangement in a sectioned side view turned through 90° relative to FIG. 5*a*. More than the four illustrated rotor nozzles can also be inserted into the holding tube 80.

Basically the hollow holding part 80 can have a desired shape adapted to the specific application.

A pre-shaped metal component is thus made available in the form of a holding part 80, with which a desired number of rotor nozzles can fundamentally either be directly coupled, as shown in FIGS. 5*a* and 5*b*, or coupled flow-wise via intermediate elements.

What is claimed is:

1. Apparatus for ejecting liquid comprising a plurality of rotor nozzles combined into a unit, each rotor nozzle including a nozzle housing defining a rotor space and having an inlet opening at one axial end of the rotor space and an outlet opening at another axial end of the rotor space through which liquid can flow, a cup bearing at an end of the rotor space proximate the outlet opening, a rotor arranged in the rotor space, the rotor being movable relative to a longitudinal axis of the rotor space and including a nozzle region at an end of the rotor facing the outlet opening, the nozzle region being supported by the cup bearing, a passage in the rotor terminating at an end of the rotor and in flow communication with the outlet opening in the housing, the rotor being inclined relative to the longitudinal axis of the rotor space and supported by an inner wall of the rotor space, and at least one common supply space for flowing the liquid to the plurality of rotor nozzles, the supply space communicating with the rotor spaces of the rotor nozzles so that, during operation, liquid flowing from the supply space into the rotor spaces swirls within the rotor spaces, thereby causing the rotors to be rotationally driven in the rotor spaces.

2. Apparatus according to claim 1 wherein the housing comprises plastic.

3. Apparatus according to claim 1 including a plug defining the outlet opening and sealingly secured to the nozzle housing.

4. Apparatus according to claim 3 wherein the plug defines the cup bearing.

5. Apparatus according to claim 4 wherein the plug is secured to the nozzle housing by one of fusing and screwing the plug to the nozzle housing.

6. Apparatus according to claim 1 including at least one carrier element having at least one connection region for attaching a substantially complete rotor nozzle having its own nozzle housing.

7. Apparatus according to claim 6 wherein the carrier element forms a connection stub, and including a sleeve element forming a predominant part of the at least one substantially complete rotor nozzle sealingly connected to the collection stub, the sleeve element and the carrier element defining the nozzle housing for the at least one substantially complete rotor nozzle.

8. Apparatus according to claim 7 wherein the sleeve element forms the cup bearing and the outlet opening.

9. Apparatus according to claim 7 wherein the sleeve element is made of plastic.

10. Apparatus according to claim 7 wherein at least one of the carrier element and the sleeve element is made of a preformed metal component.

11. Apparatus according to claim 6 wherein the carrier element is made of plastic.

12. Apparatus according to claim 1 wherein at least two rotor spaces are formed in at least one nozzle housing.

13. Apparatus according to claim 1 including a liquid supply passage and a common space fluidly communicating the liquid supply passage with the inlet openings of the rotor spaces.

14. Apparatus according to claim 13 wherein the common space is formed by a ring passage.

15. Apparatus according to claim 1 including at least two nozzle housings each of which forms at least one rotor space.

16. Apparatus according to claim 1 including a plurality of nozzle housings arranged adjacent each other and a bar element arranged approximately perpendicular to longitudinal axes of the rotor spaces which mounts the nozzle housings and permits relative rotational movements between the housings.

17. Apparatus according to claim 16 wherein each nozzle housing includes a conduit arranged approximately perpendicular to the longitudinal axis of the rotor spaces for receiving the bar element, the conduit forming an inner wall having projections and communicating with the rotor spaces, and a liquid supply passage defined by one of the nozzle housings and oriented approximately perpendicular to the conduit, the conduit being in fluid communication with the supply passage.

18. Apparatus according to claim 1 comprising a hand-held washing brush, and including at least one nozzle housing in which rotor spaces are arranged in a plurality of rows.

19. Apparatus according to claim 18 wherein the at least one nozzle housing includes a handle part defining a supply passage for the liquid, the supply passage communicating with the rotor spaces via passageways formed in the nozzle housing.

20. Apparatus according to claim 18 wherein the washing brush includes a handle part defining a liquid supply passage in fluid communication via a hose connection with each of the rotor spaces.

21. Apparatus according to claim 18 including means for fluidly connecting the rotor spaces to an external source of liquid.

22. Apparatus according to claim 1 defining a shower head and including at least one nozzle housing having rotor spaces arranged approximately circularly about a central axis, the longitudinal axes of the rotor spaces being arranged approximately parallel to the central axis.

23. Apparatus according to claim 22 wherein the at least one nozzle housing forms a ring passage extending about the central axis which is in fluid communication with the rotor spaces, and including a supply passage for the liquid having a longitudinal axis which is coaxial with the central axis.

24. Apparatus according to claim 22 including a spigot arranged approximately concentrically to the central axis and wherein the at least one nozzle housing is displaceably mounted on the spigot for conversion of the shower head between rotational operation and normal operation.

25. Apparatus according to claim 1 including at least one nozzle housing in which rotor spaces are arranged in a row, and at least one wheel mounted on an axle which extends approximately parallel to the row of rotor spaces.

26. Apparatus according to claim 25 including projections on the at least one nozzle housing and brushes mounted on the projections.

27. Apparatus according to claim 1 including a tubular holding part, wherein the plurality of rotor nozzles are independently attached to the holding part, and wherein the rotor spaces are in fluid communication with an interior of the holding part.

28. Apparatus according to claim 27 including a screw connection between nozzle housings of the rotor nozzles and the holding part.

29. Apparatus according to claim 27 wherein at least one of the holding part and the nozzle housings comprises a preformed metal component.

30. Apparatus for ejecting a liquid comprising a housing forming first and second rotor spaces, each rotor space including a liquid inlet at one end of each rotor space, an outlet at another end of each rotor space and an inner wall between the ends so that the liquid can flow into and out of each rotor space, a cup bearing in each rotor space located proximate the outlet thereof, and an elongated rotor in each rotor space, an end of the rotor being loosely supported by the cup bearing and the inner wall of each rotor space being sized so that the inner wall maintains the rotor, when supported by the cup bearing, in an angularly inclined position relative to a longitudinal axis of the rotor space, each rotor further having an internal passage for flowing the liquid from each rotor space along the passage through the outlet opening to an exterior of the housing while the inner wall of each rotor space limits the angular inclination of the rotor and permits the rotor to rotate along a substantially conical path having an apex proximate the outlet opening, and at least one common supply space communicating with each rotor space so that liquid flowing from the at least one supply space into each rotor space causes liquid in each rotor space to swirl to thereby rotate each rotor along a substantially conical path.

* * * * *